US011541404B2

(12) United States Patent
Cipriani et al.

(10) Patent No.: US 11,541,404 B2
(45) Date of Patent: Jan. 3, 2023

(54) DIRECTIONAL SPEAKER-IMPLEMENTED SHOWERHEAD

(71) Applicant: Delta Faucet Company, Indianapolis, IN (US)

(72) Inventors: Mark Cipriani, Carmel, IN (US); Patrick B. Jonte, Zionsville, IN (US); Thomas Edward Gospel, Carmel, IN (US)

(73) Assignee: Delta Faucet Company, Indianapolis, IN (US)

( * ) Notice: Subject to any disclaimer, the term of this patent is extended or adjusted under 35 U.S.C. 154(b) by 200 days.

(21) Appl. No.: 16/863,194

(22) Filed: Apr. 30, 2020

(65) Prior Publication Data

US 2020/0346228 A1 Nov. 5, 2020

Related U.S. Application Data

(60) Provisional application No. 62/841,508, filed on May 1, 2019.

(51) Int. Cl.

| | |
|---|---|
| ***B05B 1/18*** | (2006.01) |
| ***G10K 11/178*** | (2006.01) |
| ***H04R 1/02*** | (2006.01) |

(52) U.S. Cl.

CPC ..... *B05B 1/18* (2013.01); *G10K 11/178* (2013.01); *H04R 1/028* (2013.01)

(58) Field of Classification Search

CPC ..... B05B 1/18; H04R 1/028; G10K 11/178

See application file for complete search history.

(56) References Cited

U.S. PATENT DOCUMENTS

| | | | |
|---|---|---|---|
| 4,880,145 | A | 11/1989 | McManus |
| 4,964,181 | A | 10/1990 | Alpert |

(Continued)

FOREIGN PATENT DOCUMENTS

| | | |
|---|---|---|
| CN | 103551272 | 2/2014 |
| CN | 103721873 | 4/2014 |

(Continued)

OTHER PUBLICATIONS

Mad Systems, Speakers, speaker and speakers, retrieved from https://madsystems.com/2016/04/12/speakers-speakers-and-speakers, at least as early as Jan. 23, 2019, 10 pages.

(Continued)

*Primary Examiner* — Ping Lee

(74) *Attorney, Agent, or Firm* — Bose McKinney & Evans LLP

(57) ABSTRACT

A showerhead assembly with a plurality of speakers is disclosed. The illustrative showerhead assembly includes a showerhead to exert fluid, a support structure to transport the fluid to the showerhead, and a plurality of speakers to exert sound with a consistent directionality. The showerhead assembly illustratively includes a dome housing having an inner wall and an outer rim, a showerhead to exert fluid, a support structure extending from a center of the housing such that the support structure has a first end attachable to a wall or ceiling and a second end distal from the first end and the support structure transports the fluid to the showerhead, and a plurality of speakers disposed on the support structure such that the speakers are directed toward the inner wall of the housing and the speakers generate and exert sound with a consistent directionality.

14 Claims, 8 Drawing Sheets

(56) References Cited

U.S. PATENT DOCUMENTS

| | | | |
|---|---|---|---|
| 5,140,254 | A | 8/1992 | Katzman |
| 5,329,650 | A | 7/1994 | Zaccai et al. |
| 5,499,767 | A | 3/1996 | Morand |
| 5,697,557 | A | 12/1997 | Blessing et al. |
| 6,038,715 | A | 3/2000 | Flieger et al. |
| 6,170,765 | B1 | 1/2001 | Gil et al. |
| 6,354,518 | B1 | 3/2002 | Gil et al. |
| 6,442,775 | B1 | 9/2002 | Gransow et al. |
| 6,556,684 | B1 | 4/2003 | Macey |
| 6,823,536 | B2 | 11/2004 | Yip |
| 6,879,818 | B2 | 4/2005 | Wageneck |
| 6,892,952 | B2 | 5/2005 | Chang et al. |
| 7,770,825 | B2 | 8/2010 | Kajuch |
| 8,020,787 | B2 | 9/2011 | Leber et al. |
| 8,146,838 | B2 | 4/2012 | Luettgen et al. |
| 8,205,810 | B2 | 6/2012 | Lacher et al. |
| 8,360,346 | B2 | 1/2013 | Furseth |
| 8,528,840 | B2 | 9/2013 | Lacher et al. |
| 2003/0041206 | A1 | 2/2003 | Dickie |
| 2005/0025327 | A1 | 2/2005 | Macey et al. |
| 2006/0208111 | A1 | 9/2006 | Tracy et al. |
| 2007/0228189 | A1 | 10/2007 | Kajuch |
| 2008/0271240 | A1 | 11/2008 | Leber et al. |
| 2008/0302886 | A1 | 12/2008 | Hodel et al. |
| 2009/0031492 | A1 | 2/2009 | Foutz et al. |
| 2009/0109638 | A1 | 4/2009 | Kim |
| 2009/0307836 | A1 | 12/2009 | Blattner et al. |
| 2009/0323761 | A1 | 12/2009 | Tsai |
| 2010/0019067 | A1 | 1/2010 | Okuma |
| 2010/0038446 | A1 | 2/2010 | Mora |
| 2011/0088784 | A1 | 4/2011 | Meehan |
| 2011/0147490 | A1 | 6/2011 | Chen |
| 2012/0217321 | A1 | 8/2012 | Lin |
| 2012/0248222 | A1 | 10/2012 | Evans et al. |
| 2013/0032647 | A1 | 2/2013 | Zhou et al. |
| 2013/0062437 | A1 | 3/2013 | Hanna et al. |
| 2013/0239320 | A1 | 9/2013 | Aihara et al. |
| 2013/0333764 | A1 | 12/2013 | Wright |
| 2014/0034758 | A1 | 2/2014 | Buehler et al. |
| 2014/0183279 | A1 | 7/2014 | Hanna et al. |
| 2015/0053790 | A1 | 2/2015 | Hanna et al. |
| 2015/0208152 | A1 | 7/2015 | Hanna et al. |
| 2016/0236212 | A1 | 8/2016 | Patton et al. |
| 2017/0152650 | A1 | 7/2017 | Hanna et al. |

FOREIGN PATENT DOCUMENTS

| | | |
|---|---|---|
| CN | 203525935 | 4/2014 |
| EP | 2 218 512 A1 | 8/2010 |
| WO | WO 2013/036631 | 3/2013 |

OTHER PUBLICATIONS

Soundtube Entertainment, FP6020-II, Sound-Focusing Speaker, retrieved from https://mseaudio-soundtube-downloads.s3-us-west-2.amazonaws.com/FP6020-II+Tech+Sheet.pdf, Feb. 14, 2012, 4 pages.

AMS, AS3435 Active Noise Cancellation Speak Driver, retrieved from https://www.digikey.com/en/product-highlight/a/ams/as3435-active-noise-cancellation#:~:text=ams'%20AS3435%20are%20speaker%20drivers,by%20reducing%20background%20ambient%20noise, at least as early as Jan. 23, 2019, 2 pages.

Screenshots from Youtube video, Motion Study of the Gerotor Motor, Apr. 19, 2011, 2 pages.

Five considerations when choosing Geroler motors, retrieved from https://www.eaton.com/us/en-us/products/motors-generators/high-torque/five-considerations-when-choosing-geroler-motors.html, at least as early as Jan. 23, 2019, 9 pages.

Sten Wahlström, "The Parabolic Reflector as an Acoustical Amplifier", Journal of Audio Engineering Society, 33/6, pp. 418-429, Jun. 1985 (Jun. 1985).

DIRECTIONAL SPEAKER-IMPLEMENTED SHOWERHEAD

CROSS-REFERENCE TO RELATED APPLICATION

The present application claims priority to U.S. Provisional Patent Application Ser. No. 62/841,508, filed May 1, 2019, the disclosure of which is expressly incorporated herein by reference.

BACKGROUND AND SUMMARY OF THE DISCLOSURE

The present disclosure relates generally to audio systems, especially to audio systems designed for use in a shower.

Some people enjoy listening to music while taking a shower, but the shower room or bathroom is designed such that sound from an audio speaker placed anywhere in the room may cause unwanted echoes and reverberations due to the floor and walls reflecting soundwaves with minimal absorption. Also, the white noise caused by the water adds to the unwanted noises that echo within the room, so the common way to improve the audibility of the music is to increase its volume, which may be not only disturbing to those outside the bathroom but also too loud for the comfort of the listener inside the shower. As such, there is a need for an improved audio system within the bathroom that causes minimal echoes and reverberations and allows the user to comfortably enjoy music better while taking the shower.

Various illustrative embodiments of the present disclosure relate to a showerhead assembly including a showerhead configured to discharge fluid, a support structure configured to transport the fluid to the showerhead, and a plurality of speakers configured to exert sound with a consistent directionality. In one embodiment, the showerhead assembly includes a dome housing having an inner wall and an outer rim, a showerhead configured to discharge fluid, a support structure extending from a center of the housing such that the support structure has a first end attachable to a wall or ceiling and a second end distal from the first end and the support structure transports the fluid to the showerhead, and a plurality of speakers disposed on the support structure such that the speakers are directed toward the inner wall of the housing and the speakers generate and exert sound with a consistent directionality.

In one illustrative embodiment, the dome housing is a paraboloid. In another illustrative embodiment, the speakers are configured such that a source of the sound is located at a focal point of the paraboloid. In one illustrative embodiment, the sound is exerted such that waves of the sound travel parallel to each other. In another illustrative embodiment, the plurality of speakers have noise-cancelling capability. In one illustrative embodiment, the showerhead is disposed on the second end of the support structure. In another illustrative embodiment, the showerhead is disposed on the outer rim of the housing. In one illustrative embodiment, the showerhead assembly includes at least one additional showerhead disposed on the outer rim of the housing such that the at least one additional showerhead discharges the fluid. In one illustrative embodiment, the showerhead assembly further includes a hydrogenerator disposed on the support structure such that the hydrogenerator receives at least a portion of the fluid transported by the support structure to generate energy to power the plurality of speakers.

Also disclosed herein are various illustrative embodiments related to a showerhead which includes a support structure having a first end attachable to a wall or ceiling and a second end distal from the first end such that the support structure transports fluid, a nozzle attached to the second end of the support structure and configured to receive the fluid, and a plurality of speakers disposed in the nozzle, the speakers configured to generate and exert sound with a consistent directionality. The nozzle has a surface with a first region and a second region, the first region comprised of at least one sound opening configured to exert sound generated by the speakers, the second region comprised of at least one fluid opening configured to exert the fluid transported by the support structure, and the first and second regions configured such that the sound and the fluid are exerted from the showerhead with a consistent directionality.

In one illustrative embodiment, the first region is surrounded by the second region. In another illustrative embodiment, the second region is surrounded by the first region. In yet another illustrative embodiment, the first and second regions are interspersed. In an additional embodiment, the sound and fluid are exerted such that the sound and the fluid travel parallel to each other.

While multiple embodiments are disclosed, still other embodiments of the present disclosure will become apparent to those skilled in the art from the following detailed description, which shows and describes illustrative embodiments of the disclosure. Accordingly, the drawings and detailed description are to be regarded as illustrative in nature and not restrictive.

BRIEF DESCRIPTION OF THE DRAWINGS

The embodiments will be more readily understood in view of the following description when accompanied by the below figures and wherein like reference numerals represent like elements. These depicted embodiments are to be understood as illustrative of the disclosure and not as limiting in any way.

Figure 1:
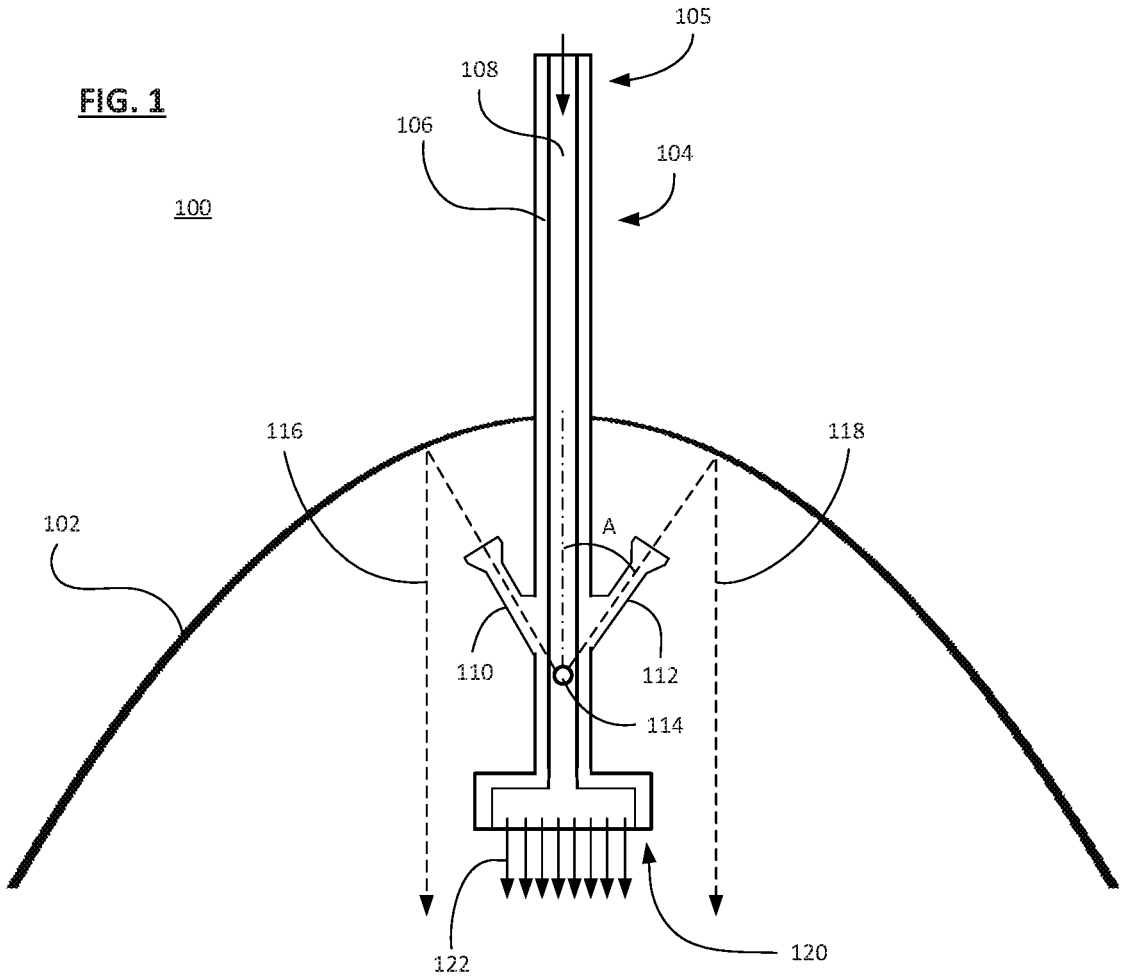
FIG. 1 is a schematic diagram of a showerhead assembly according to an illustrative embodiment as disclosed herein.

While the present disclosure is amenable to various modifications and alternative forms, specific embodiments have been shown by way of example in the drawings and are described in detail below. The intention, however, is not to limit the present disclosure to the particular embodiments described. On the contrary, the present disclosure is intended to cover all modifications, equivalents, and alternatives falling within the scope of the present disclosure as defined by the appended claims.

DETAILED DESCRIPTION OF THE DISCLOSURE

In the following detailed description, reference is made to the accompanying drawings which form a part hereof, and in which is shown by way of illustration specific embodiments in which the present disclosure is practiced. These embodiments are described in sufficient detail to enable those skilled in the art to practice the present disclosure, and it is to be understood that other embodiments can be utilized and that structural changes can be made without departing from the scope of the present disclosure. Therefore, the following detailed description is not to be taken in a limiting sense, and the scope of the present disclosure is defined by the appended claims and their equivalents.

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments. Furthermore, the described features, structures, or characteristics of the subject matter described herein may be combined in any suitable manner in one or more embodiments.

FIG. 1 shows a showerhead assembly 100 according to an illustrative embodiment in which a dome housing 102 is attached to and supported by a support structure 104, an attachment portion 105 of which attaches to a bathroom wall or ceiling to receive fluid, usually water, therefrom. The support structure 104 attaches to the center of the dome housing and has two components: an outer component 106 and an inner piping 108. The outer component 106 is connected to and supports two speakers 110 and 112 extending radially therefrom such that there is a 180-degree angle between the positions of the two speakers. The speakers 110 and 112 are positioned such that sound waves 116 and 118 exerted from these speakers bounce off an inner wall of the dome housing 102 and travels in a general direction of a user who would be using the showerhead assembly 100 to take a shower. The angle A formed between the speaker 110 or 112 and a longitudinal axis of the support structure 104 is an acute angle, i.e. between 0 and 90 degrees. In one example, the range of this angle A is between 10 and 20 degrees; in another example, the range is between 20 and 30 degrees; in another example, the range is between 30 and 40 degrees; in another example, this range is between 40 and 50 degrees; in another example, the range is between 50 and 60 degrees; in another example, the range is between 60 and 70 degrees; and in another example, the range is between 70 and 80 degrees.

Figure 2:
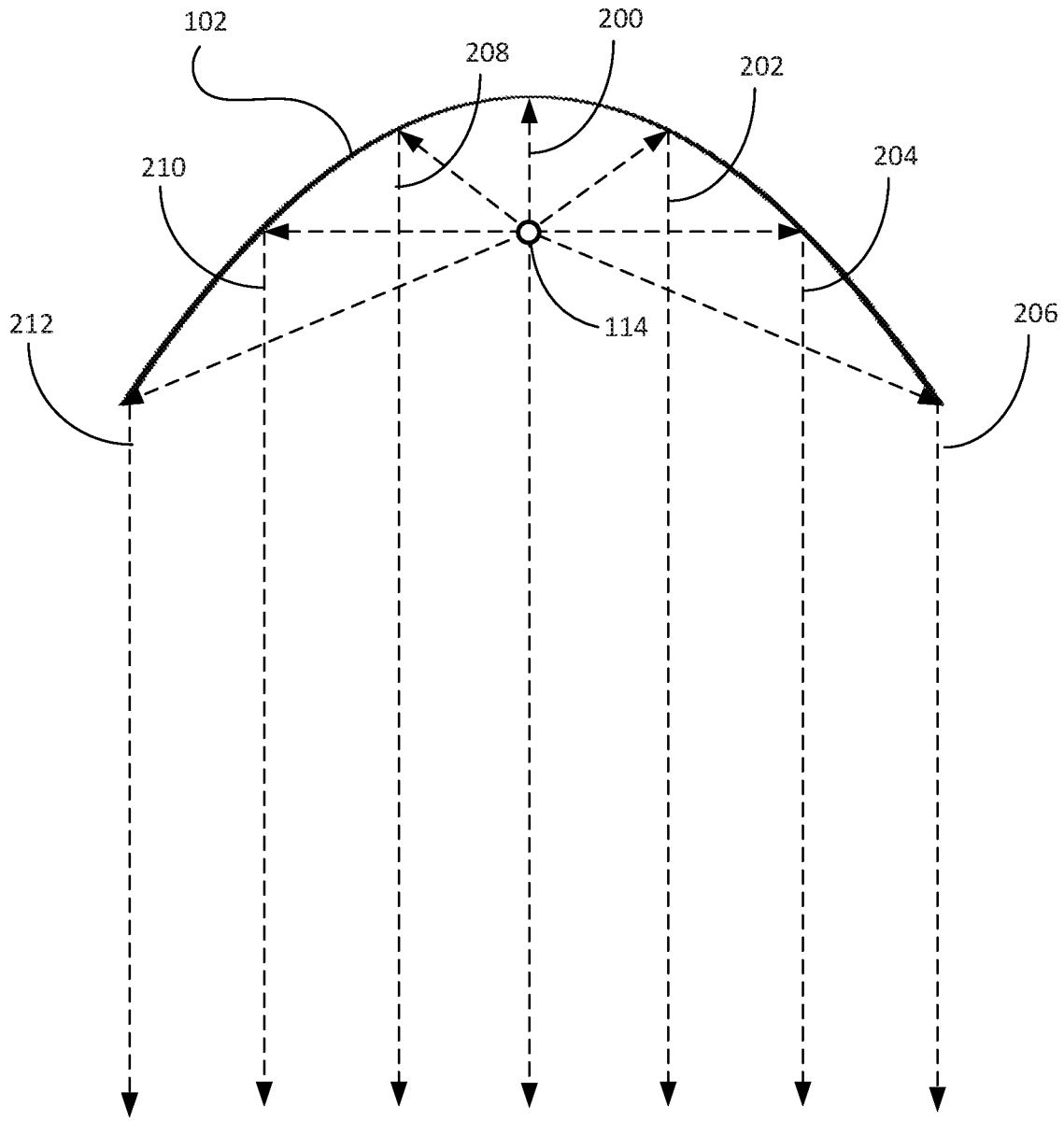
FIG. 2 is a schematic diagram illustrating how the soundwaves travel within the parabola according to an illustrative embodiment as disclosed herein.

In the example shown in FIG. 1, the dome housing 102 is a paraboloid. The paraboloid housing 102 has a focal point 114 which is located as a source of the sound exerted from the two speakers 110 and 112. These speakers are configured such that the source of the sound coincides with the focal point 114 and the sound is exerted outwardly away from the focal point 114 toward the housing 102, such that the sound waves travel parallel to each other after they bounce off the housing 102, as shown in FIG. 2. FIG. 2 illustrates an example of how seven different sound waves 200, 202, 204, 206, 208, 210, and 212 originating from the same focal point 114 but traveling in different directions ultimately travel parallel to each other after bouncing off the paraboloid housing 102. As such, in this example, the sound waves are prevented from dispersing in random directions but instead aligned in a precoordinated configuration.

The support structure 104 also has a showerhead 120 which exerts fluid 122 drawn from the wall or ceiling, located on the other end of the structure 104 from the attachment portion 105. In this and subsequent figures shown herein, the directions of the fluid are illustrated in solid arrows, while the directions of the sound waves are illustrated in broken arrows. In this example, the inner piping 108 directs the flow of fluid away from the attachment portion 105 toward the showerhead 120, and the showerhead exerts the fluid in the direction of the user. Therefore, the direction in which the fluid travels is the same as the direction in which the sound waves travel, thereby allowing a consistent directionality in the flow of both the fluid and the sound. Advantages of such consistent directionality includes a reduction in the interference noise that arise from two sound waves overlapping with and interfering each other, as well as preventing the fluid from bending the direction in which the sound waves travel. Therefore, to reduce such interruption between fluid and sound, the showerhead 120 is located on the distal end of the support structure 104 from the wall or ceiling, and the speakers 110 and 112 are located in the interval between the showerhead 120 and the housing 102.

Figure 3:
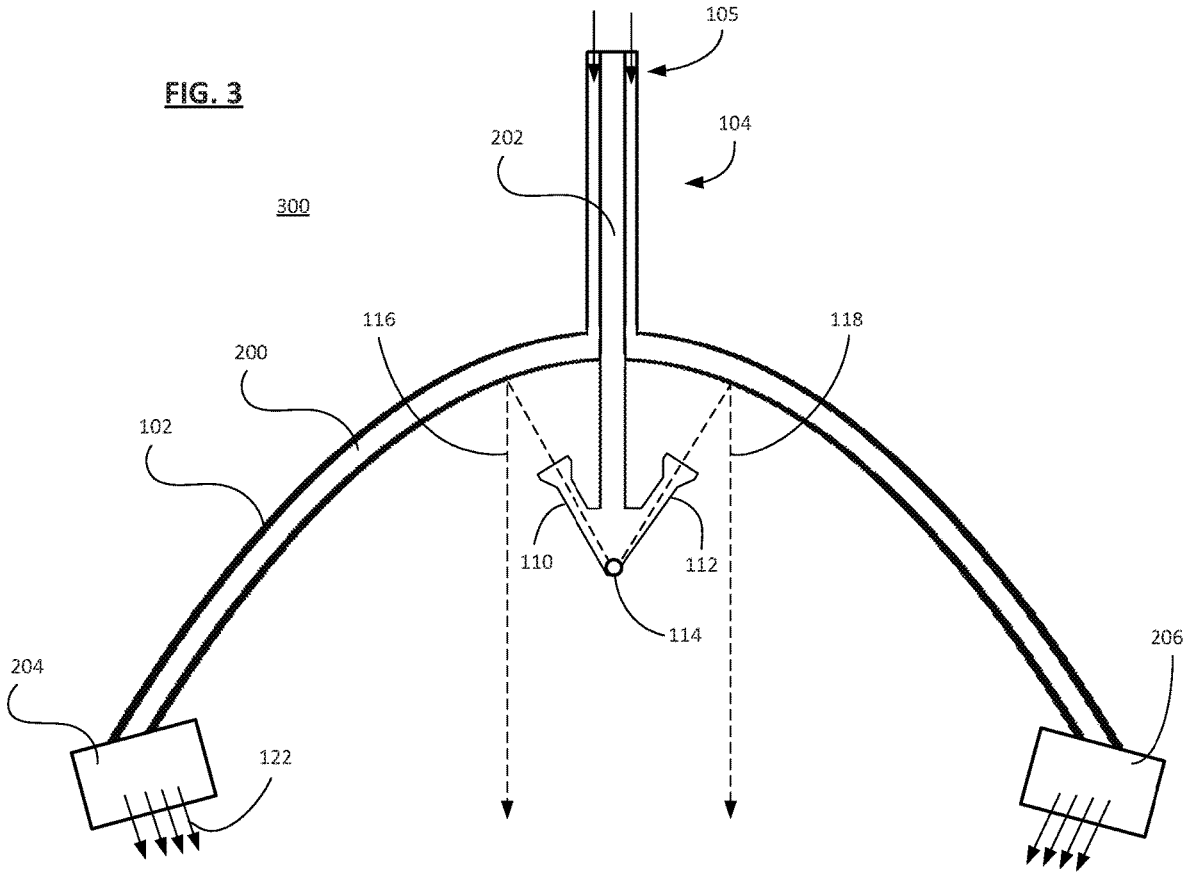
FIG. 3 is a schematic diagram of a showerhead assembly according to an illustrative embodiment as disclosed herein.

FIG. 3 shows another illustrative embodiment of a showerhead assembly 300 in which a piping 302 is incorporated with the dome housing 102. In this embodiment, a support structure 303 supports the two speakers 110 and 112 while also supporting the piping 302 which carries the fluid from the attachment portion 105 to at least two showerheads 304 and 306 located at the end of the dome housing 102. Unlike the assembly 100, the piping 302 does not extend toward the speakers 110 and 112. In some examples, there are three, four, or more showerheads, and the fluid is directed from each showerhead towards the user. The piping 302 may be inside the inner and outer walls of the dome housing 102 in one example. In another example, the piping 302 attaches to a surface of the dome housing 102, preferably on the outer wall surface, such that the piping 302 follows an outer contour of the dome housing 102. The speakers 110 and 112 also face away from the focal point 114 and directs the sound waves toward the inner wall of the dome housing 102, causing the sound waves to bounce off the inner wall and travel toward the user in directions parallel to each other. Advantages of this configuration include the lack of fluid interruption on the sound waves, because the positioning of the showerheads 304 and 306 can be adjusted such that the sound waves 116 and 118 from the speakers 110 and 112 reach the head of the user while the fluid 122 from the showerheads 304 and 306 reaches below at or the neck of the user, for example, such that the sound can be heard by the user while taking shower without having the fluid bending the direction of the sound waves.

Figure 4:
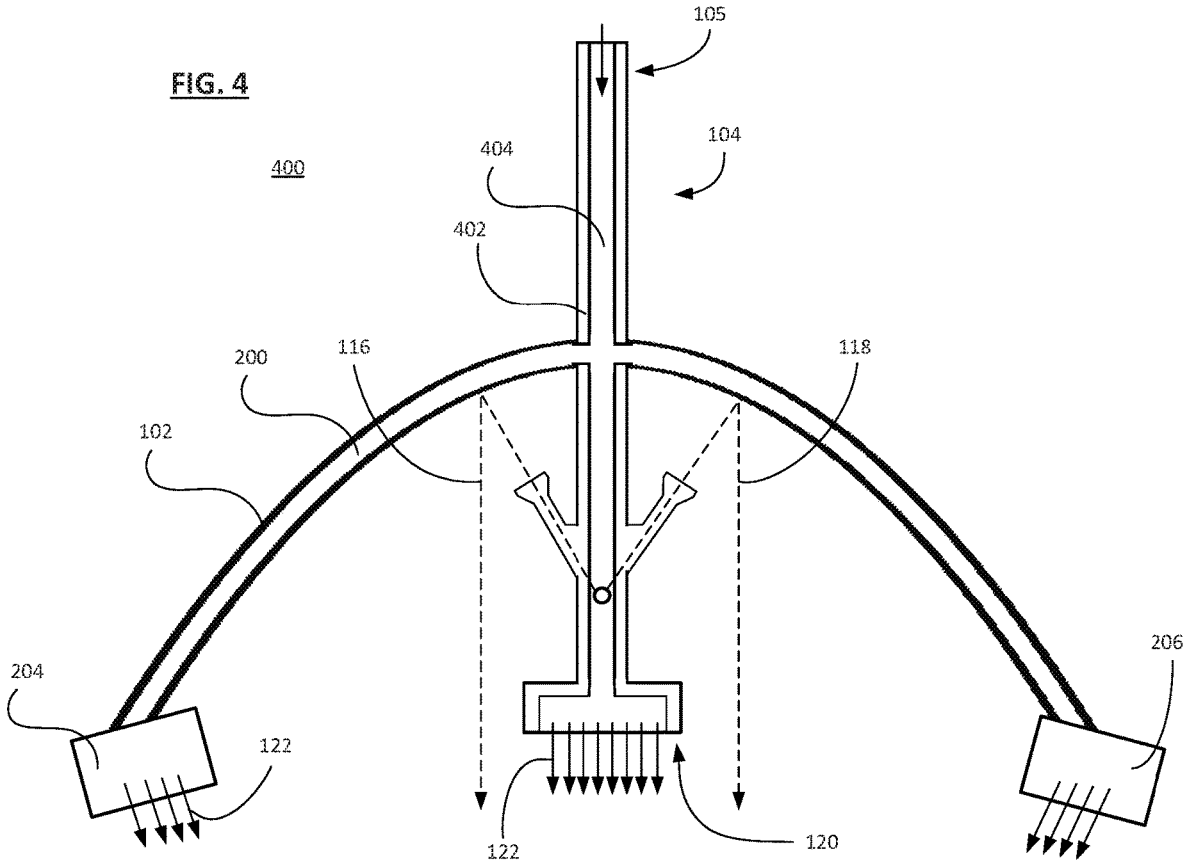
FIG. 4 is a schematic diagram of a showerhead assembly according to an illustrative embodiment as disclosed herein.

FIG. 4 shows a showerhead assembly 400 according to one illustrative embodiment which includes the features from both of the showerhead assemblies 100 and 300. Specifically, the showerhead assembly 400 has the support structure 104 which includes an outer component 402 which defines an inner piping 404 that provides fluid flow to not only the showerhead 120 but also to the piping 302 leading to the additional showerheads 304 and 306 on the outer edge of the dome housing 102. As with the previous examples, the support structure 402 provides support for the speakers 110 and 112 in a position as described above.

Figure 5:
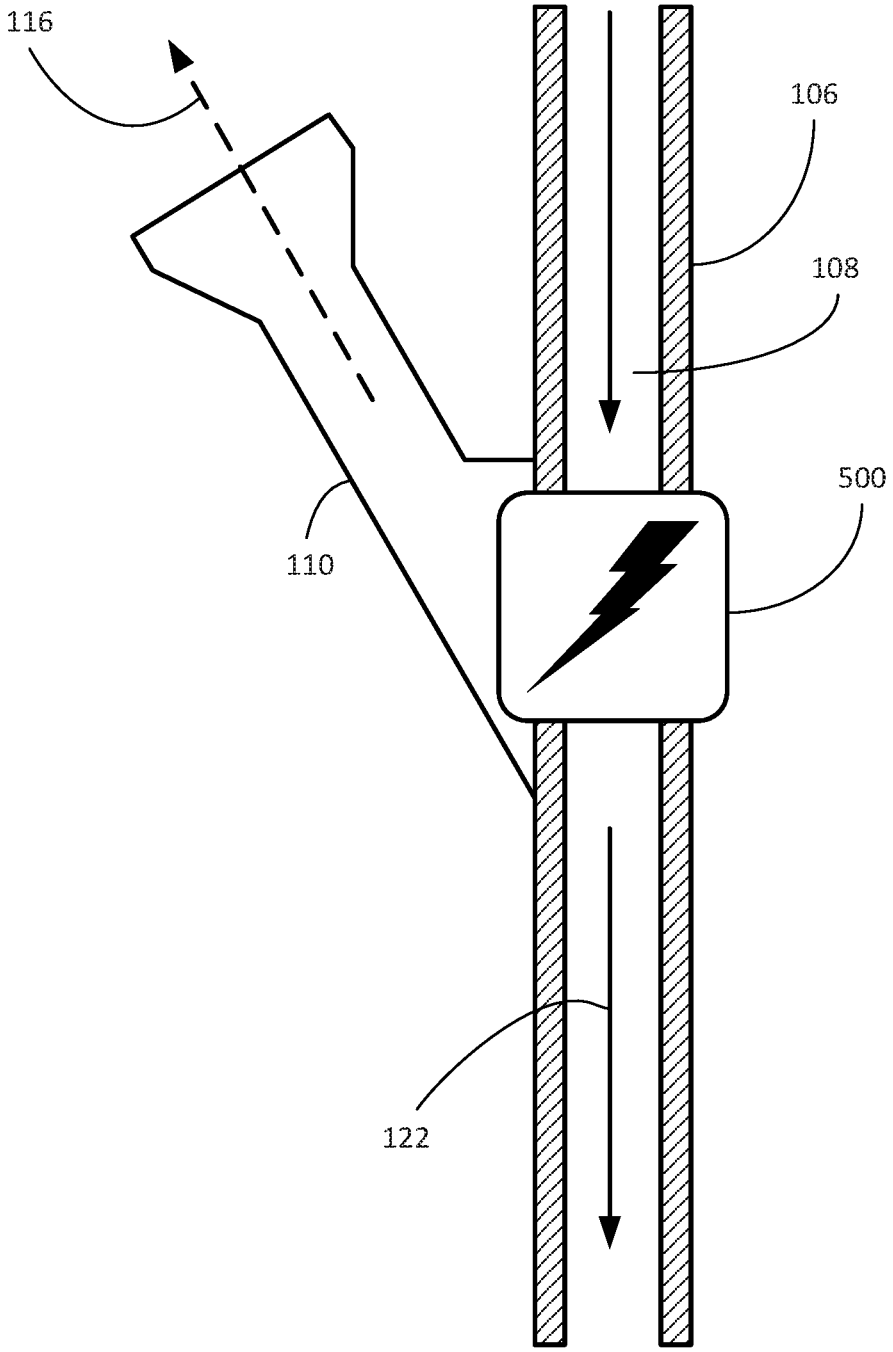
FIG. 5 is a schematic diagram of a showerhead assembly according to an illustrative embodiment as disclosed herein.

FIG. 5 shows a hydrogenerator 500 disposed on the support structure 106 according to one embodiment. The hydrogenerator 500 receives at least a portion of the fluid 122 transported through the inner piping 108 to generate energy to power the speakers (only speaker 110 is illustrated in this figure). As such, the speakers 110 and 112 in this example do not need to be plugged into an external power socket locate on a wall or ceiling to which the showerhead assembly is attached, and thereby only use the power supplied by the hydrogenerator 500 to provide sound. Because the proximity of the speakers 110 and 112 to the user, the volume of the sound exerted from the speakers do not need to be very loud, thereby keeping the power requirement for these speakers low. In one example, only approximately 15 watts of electrical power is necessary for the speakers, which can be provided with a power-efficient hydrogenerator from the flow of fluid when using the shower.

In one example, the hydrogenerator 500 uses a positive-displacement turbomachine while in another example, the hydrogenerator 500 may use a dynamic turbomachine. A positive-displacement turbomachine is a device that contains a closed volume; energy is transferred to the fluid (pump) or from the fluid (turbine) via movement of the boundaries of the closed volume. On the other hand, a dynamic turbomachine has no closed volume; instead, energy is transferred to the fluid (pump) or from the fluid (turbine) via rotating blades. Examples of positive-displacement pumps include well pumps, hearts, some aquarium pumps, and pumps designed to release precise volumes of medicine. Examples of positive-displacement turbines include water meters and gas meters in the home. Examples of dynamic pumps include fans, centrifugal blowers, airplane propellers, centrifugal water pumps (like in a car engine), etc. Examples of dynamic turbines include windmills, wind turbines, turbine flow meters, etc. In another example, the hydrogenerator 500 may use lobe type motors. Other suitable types of suitable hydrogenerators may be used as appropriate.

Figure 6:
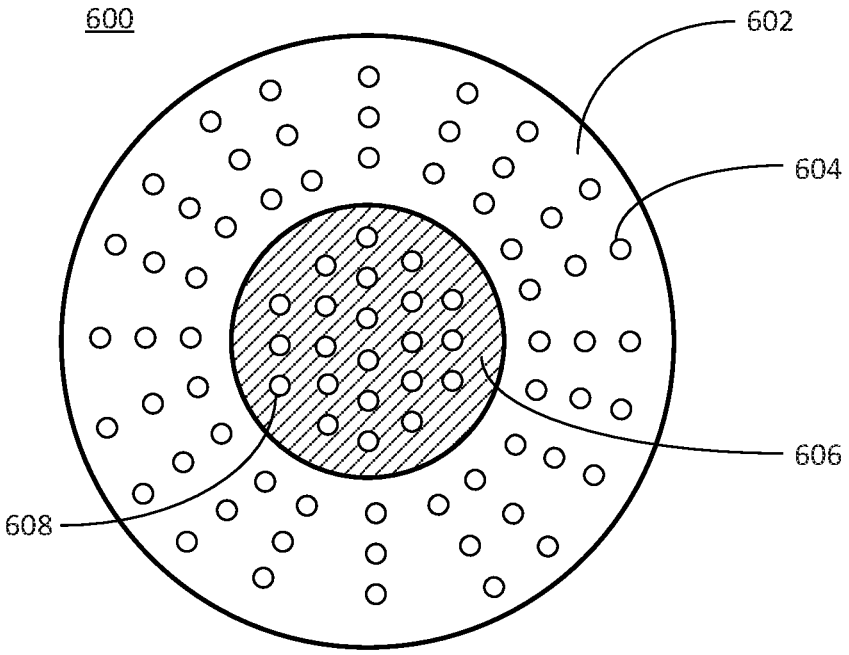
FIG. 6 is a schematic diagram of a showerhead nozzle according to an illustrative embodiment as disclosed herein.
Figure 7:
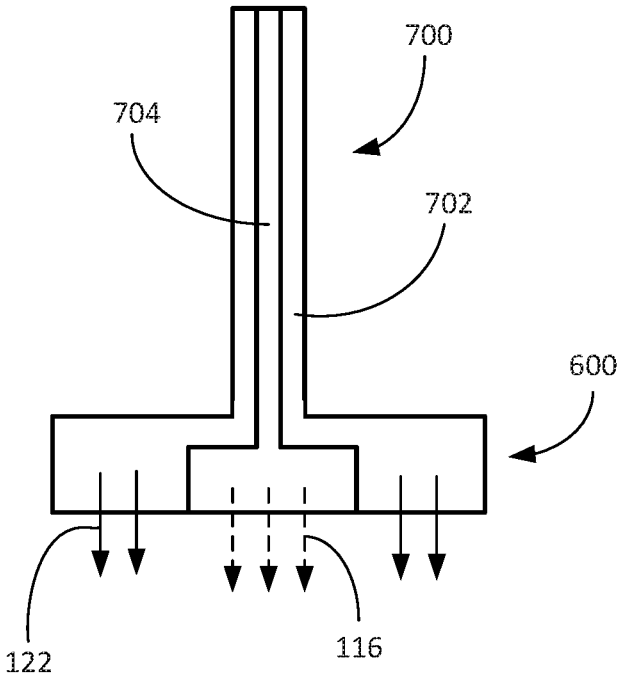
FIG. 7 is a schematic diagram of a showerhead assembly according to an illustrative embodiment as disclosed herein.

FIGS. 6 and 7 illustrate a showerhead 600 according to an illustrative embodiment. The showerhead 600 includes a piping section 602 on the outer region defining a plurality of openings 604 for fluid such as water to be exerted therefrom and a speaker section 606 on the inner region with a plurality of openings 608 for sound to be exerted therefrom, where both fluid and sound are directed toward the user such that they travel parallel to each other and there is minimal interference among the fluid and sound waves. The showerhead 600 is located at an end of a support structure 700 which has a piping 702 to transport fluid and a speaker support structure 704 located within the piping 702 to support the speaker section 606.

Figure 8:
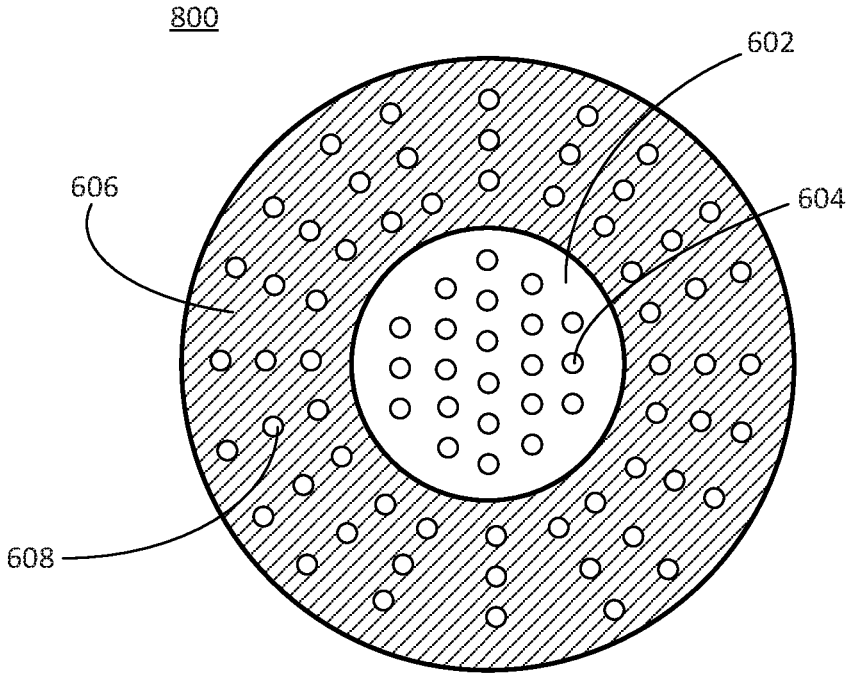
FIG. 8 is a schematic diagram of a showerhead nozzle according to an illustrative embodiment as disclosed herein.
Figure 9:
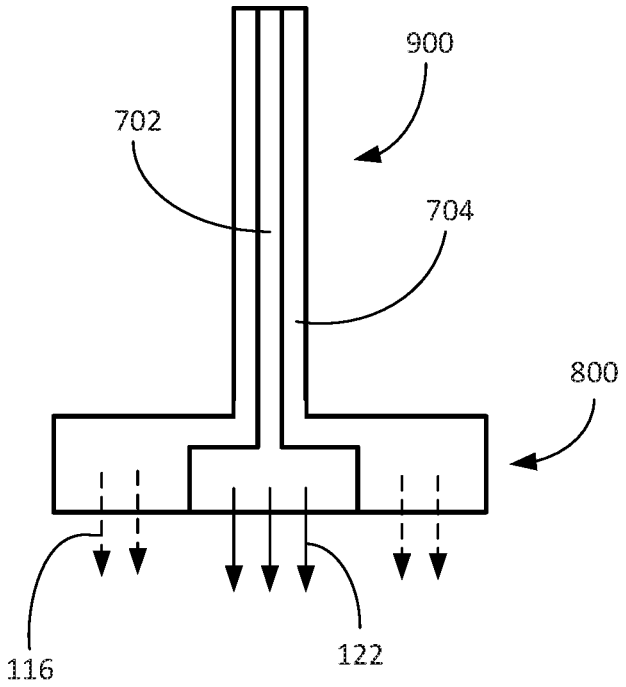
FIG. 9 is a schematic diagram of a showerhead assembly according to an illustrative embodiment as disclosed herein.

FIGS. 8 and 9 illustrate a showerhead 800 according to another illustrative embodiment. The showerhead 800 includes the speaker section 606 on the outer region and the piping section 602 on the inner region. Therefore, the speaker support structure 704 is on the outside of the piping 702. In one example, the piping 702 may be a solid pipe and the speaker section 606 is attached to the end of the pipe to allow both the piping section 602 and the speaker section 606 to face toward the user.

Figure 10:
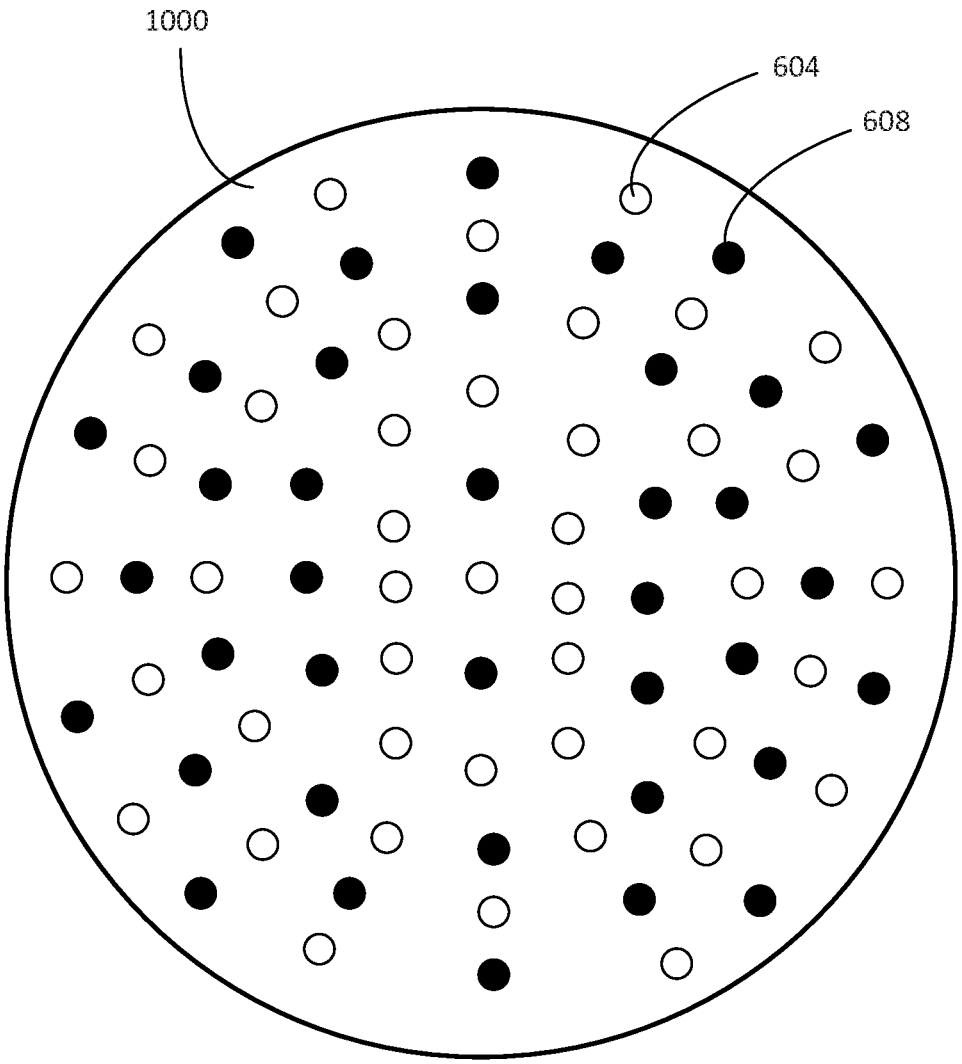
FIG. 10 is a schematic diagram of a showerhead nozzle according to an illustrative embodiment as disclosed herein.

FIG. 10 illustrates a showerhead 1000 according to yet another illustrative embodiment. The showerhead 1000 includes the fluid openings 604 (depicted as unfilled circles) and the sound openings 608 (depicted as filled circles) are interspersed, such that the openings 604 and 608 are not necessarily defined by a contiguous region. In one example, the fluid openings 604 and the sound openings 608 may be arranged in a checkerboard pattern such that each fluid opening 604 is surrounded by sound openings 608, and vice versa. In another example, each set of fluid openings 604 may be arranged in a line extending radially from the center of the showerhead 1000, and positioned next to this set of fluid openings 604 may be a set of sound openings 608 also arranged in a line extending radially from the center of the showerhead 1000. In yet another example, the openings 604 and 608 may be positioned in a relatively random manner, as depicted in FIG. 10.

In the above embodiments, the speakers used are any suitable electroacoustic transducers which receive and convert electrical audio signals into sounds. In one example, the speakers are dynamic speakers which receive the electrical audio signals via wireless transmissions such as Bluetooth, infrared communication, near-field communication, and the like. In one example, the speakers are water-resistant or waterproof to prevent malfunctioning when coming into contact with the water or water vapor from the shower. In one example, the speakers are equipped with active noise cancellation, reduction, and control features, such that the sound of shower and echoes within the room can be reduced via destructive interference. In one aspect, the showerhead assembly includes a set of noise-cancelling speakers which emit sound waves with inverted phase with respect to the sound waves that they receive, thereby resulting in destructive interference.

Furthermore, in the above embodiments, the material of the dome housings may be acrylic, plastic, or any other suitable polymer materials which enable efficient reflectivity. In one example, the dome housings are lightweight to minimize burden on the support structures. In another example, the dome housings are transparent or translucent. Additionally, the piping and showerhead may be made of metals such as steel. In one example, the support structure has adjustable length so that the showerhead assembly can be lowered or raised according to the user's height and preference.

The present subject matter may be embodied in other specific forms without departing from the scope of the present disclosure. The described embodiments are to be considered in all respects only as illustrative and not restrictive. Those skilled in the art will recognize that other implementations consistent with the disclosed embodiments are possible. The above detailed description and the examples described therein have been presented for the purposes of illustration and description only and not for limitation. For example, the operations described can be done in any suitable manner. The methods can be performed in any suitable order while still providing the described operation and results. It is therefore contemplated that the present embodiments cover any and all modifications, variations, or equivalents that fall within the scope of the basic underlying principles disclosed above and claimed herein. Furthermore, while the above description describes hardware in the form of a processor executing code, hardware in the form of a state machine, or dedicated logic capable of producing the same effect, other structures are also contemplated.

What is claimed is:

1. A showerhead assembly comprising:

a dome housing having an inner wall;

a showerhead configured to discharge fluid;

a support structure extending from a center of the housing, the support structure having a first end attachable to a wall or ceiling and a second end distal from the first end, and the support structure configured to transport the fluid to the showerhead; and a plurality of speakers supported by the support structure, the speakers directed toward the inner wall of the housing, and the speakers configured to generate and exert sound with a consistent directionality.

2. The showerhead assembly of claim 1, wherein the dome housing is a paraboloid.

3. The showerhead assembly of claim 2, wherein the speakers are configured such that a source of the sound is located at a focal point of the paraboloid.

4. The showerhead assembly of claim 1, wherein the sound is exerted such that waves of the sound travel parallel to each other.

5. The showerhead assembly of claim 1, wherein the plurality of speakers have noise-cancelling capability.

6. The showerhead assembly of claim 1, wherein the showerhead is disposed on the second end of the support structure.

7. The showerhead assembly of claim 1, wherein the showerhead is disposed on the housing.

8. The showerhead assembly of claim 7, further comprising:

at least one additional showerhead disposed on the housing, the at least one additional showerhead configured to exert the fluid.

9. The showerhead assembly of claim 1, further comprising:

a hydrogenerator disposed on the support structure, the hydrogenerator configured to receive at least a portion of the fluid transported by the support structure to generate energy to power the plurality of speakers.

10. A showerhead assembly comprising:

a showerhead configured to discharge fluid;

a support structure configured to transport the fluid to the showerhead;

a plurality of speakers supported by the support structure and configured to exert sound with a consistent directionality;

a dome housing having an inner wall; and wherein the speakers are directed toward the inner wall of the housing.

11. The showerhead assembly of claim 10, wherein the support structure extends from a center of the housing, the support structure having a first end attachable to a wall or ceiling and a second end distal from the first end.

12. The showerhead assembly of claim 10, wherein the dome housing is a paraboloid.

13. The showerhead assembly of claim 12, wherein the speakers are configured such that a source of the sound is located at a focal point of the paraboloid.

14. The showerhead assembly of claim 10, wherein the sound is exerted such that waves of the sound travel parallel to each other.

* * * * *